US008656887B2

(12) United States Patent
Negoro et al.

(10) Patent No.: US 8,656,887 B2
(45) Date of Patent: Feb. 25, 2014

(54) SPARK PLUG UNIT ARRANGEMENT WITHIN A MOTORCYCLE INTERNAL COMBUSTION ENGINE

(75) Inventors: Masaaki Negoro, Saitama (JP); Yuki Nagata, Saitama (JP); Hideki Akiyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 211 days.

(21) Appl. No.: 13/190,621

(22) Filed: Jul. 26, 2011

(65) Prior Publication Data

US 2012/0024257 A1 Feb. 2, 2012

(30) Foreign Application Priority Data

Jul. 30, 2010 (JP) ..... 2010-172348

(51) Int. Cl.
*F02B 67/06* (2006.01)

(52) U.S. Cl.
USPC ..... 123/198 R; 123/169 R; 123/169 PA; 123/169 PH

(58) Field of Classification Search
USPC ..... 123/198 R, 193.1, 193.2, 193.3, 193.4, 123/193.5, 193.6, 169 R, 169 PA, 169 PH, 123/594–656, 143 R; 29/888.06; 60/322, 60/323
See application file for complete search history.

(56) References Cited

U.S. PATENT DOCUMENTS

| | | | | |
|---|---|---|---|---|
| 5,590,637 | A | 1/1997 | Motodate | |
| 5,878,706 | A | 3/1999 | Akamatsu | |
| 2009/0084098 | A1 * | 4/2009 | Tsubakino et al. | 60/324 |

FOREIGN PATENT DOCUMENTS

| | | | |
|---|---|---|---|
| DE | 69928485 | T2 | 8/2006 |
| EP | 1369560 | A2 * | 12/2003 |
| EP | 2 309 117 | A1 | 4/2011 |
| JP | 3809900 | B2 | 8/2006 |

* cited by examiner

*Primary Examiner* — Thanh Truong
*Assistant Examiner* — Ruben Picon-Feliciano
(74) *Attorney, Agent, or Firm* — Birch, Stewart, Kolasch & Birch, LLP

(57) ABSTRACT

A motorcycle with a spark plug unit disposed on a front side of a cylinder head wherein approaching the spark plug unit from the front side between a front wheel and the spark plug unit as well as a high-tension cord can be prevented, without increasing the front-rear length of the vehicle. The motorcycle includes an engine with a tubular section containing a spark plug that projects roughly in a forward direction from a front surface of a cylinder head. A spark plug cap which is connected to the spark plug in the inside of the tubular section with the high-tension cord connected to a side portion thereof is fitted to the tubular section. A portion of the tubular section which projects from the cylinder head is formed with a cutout for containing the high-tension cord and for directing the cord toward a lateral side of the tubular section.

20 Claims, 7 Drawing Sheets

SPARK PLUG UNIT ARRANGEMENT WITHIN A MOTORCYCLE INTERNAL COMBUSTION ENGINE

CROSS-REFERENCE TO RELATED APPLICATIONS

The present application claims priority under 35 USC 119 to Japanese Patent Application No. 2010-172348 filed on Jul. 30, 2010 the entire contents of which are hereby incorporated by reference.

BACKGROUND OF THE INVENTION

1. Field of the Invention

The present invention relates to a motorcycle.

2. Description of Background Art

A motorcycle is known wherein a spark plug unit is directly mounted on the front side of a cylinder head. See, for example, Japanese Patent No. 3809900.

However, in the case where the above-mentioned structure is applied to a motorcycle having a forwardly tilted engine, there may be a possibility that, under the influence of torsion of a front fork and/or a frame due to a sudden braking, the spacing between the front wheel and the engine may become smaller than that at the times of normal expansion and contraction of the front fork. Thus, the front wheel may approach the spark plug unit or a high-tension cord connected to the spark plug. If the spacing between the spark plug unit and the front wheel is enlarged for the purpose of avoiding the just-mentioned situation, the front-rear length of the vehicle would be increased.

SUMMARY AND OBJECTS OF THE INVENTION

The present invention has been made in consideration of the above-mentioned circumstances. Accordingly, it is an object of an embodiment of the present invention to provide a motorcycle in which approaching between the front wheel and a spark plug unit as well as a high-tension cord can be prevented, without increasing the front-rear length of the vehicle even when the spark plug unit is mounted on the front side of a cylinder head.

According to an embodiment of the present invention, there is provided a motorcycle including an engine having a cylinder head disposed in a forwardly tilted state, wherein a tubular section for containing a spark plug therein projects roughly forward from a front surface of the cylinder head. A spark plug cap is provided which is connected to the spark plug in the inside of the tubular section with a high-tension cord connected to a side portion thereof fitted to the tubular section. The portion of the tubular section which projects from the cylinder head is formed with a cutout for containing the high-tension cord in the state of being directed toward a lateral side of the tubular section.

According to an embodiment of the present invention, the engine is a multi-cylinder engine having a plurality of cylinders, and the tubular section is formed in a plurality according to the number of the cylinders.

According to an embodiment of the present invention, the cutout is formed to be oriented outward with reference to a center line of the engine passing through the center of the vehicle width when the engine is mounted on the vehicle, and a front wheel is disposed on an imaginary extension line, in the vehicle front-rear direction, of the center line.

According to an embodiment of the present invention, a plurality of high-tension cords is provided with the plurality of high-tension cords being disposed to oppositely extend toward outer sides with reference to the engine, in front view of the vehicle.

According to an embodiment of the present invention, the high-tension cord is disposed on the rear side relative to a front end of the engine, in side view of the vehicle.

According to an embodiment of the present invention, the engine has a cylinder head cover, and the spark plug cap is disposed on the rear side relative to a lower end of a fastening surface between the cylinder head cover and the cylinder head.

According to an embodiment of the present invention, the engine includes a cam chain chamber located on one side in the vehicle width direction when the engine is mounted on the vehicle with a water pump on the other side. The cutout is formed below the cam chain chamber and the water pump.

According to an embodiment of the present invention, a part of the high-tension cord is disposed along a down frame of a body frame.

According to an embodiment of the present invention, an exhaust port is formed between the plurality of spark plug caps, and the high-tension cord is attached to the spark plug cap so as to extend outwardly with reference to the exhaust port.

According to an embodiment of the present invention, most of the spark plug cap is contained in the cylinder head with its upper side being surrounded by the tubular section, so that the spark plug cap can be protected. In addition, since the high-tension cord is contained in the cutout in the tubular section in the state of being directed toward a lateral side of the tubular section, the high-tension cord does not project forward, so that the spacing between the high-tension cord and the front wheel can be kept larger, as compared with the case where the cutout is not formed. This ensures that, even though the spark plug cap is disposed on the front side of the cylinder head, approaching between the front wheel and the spark plug cap as well as the high-tension cord can be prevented, without increasing the front-rear length of the vehicle.

According to an embodiment of the present invention, even in a multi-cylinder engine, approaching between the front wheel and the spark plug caps as well as the high-tension cords can be prevented, without increasing the front-rear length of the vehicle.

According to an embodiment of the present invention, the cutout is formed to be oriented outward with reference to the center line. Therefore, intrusion of water or mud splashed from the front wheel can be prevented by the tubular section more assuredly, while passing the high-tension cord through the tubular section in a compacter manner, as compared with the case where the cutout is formed to be oriented inward with reference to the center line.

According to an embodiment of the present invention, the plurality of high-tension cords can be prevented from being entangled with each other, whereby mountability of the high-tension cords can be enhanced.

According to an embodiment of the present invention, the high-tension cord can be prevented from projecting toward the front side of the engine, so that approaching between the high-tension cord and the front wheel can be prevented.

According to an embodiment of the present invention, the spark plug cap can be prevented from projecting forward, so that approaching between the spark plug cap and the front wheel can be prevented.

According to an embodiment of the present invention, the cam chain chamber is provided on one side, in the vehicle width direction, of the engine, whereas the water pump is provided on the other side, and, while keeping this condition, the cutout is formed below the cam chain chamber and the water pump. Therefore, component parts can be laid out intensively at or around the cylinder head, and the engine can be made compact.

According to an embodiment of the present invention, the high-tension cord can be mounted in a compact form, without providing any superfluous space.

According to an embodiment of the present invention, while providing the spark plug cap in the vicinity of the exhaust port, it is possible to avoid approaching between the high-tension cord and component parts of the exhaust system, and to lay out the component parts intensively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
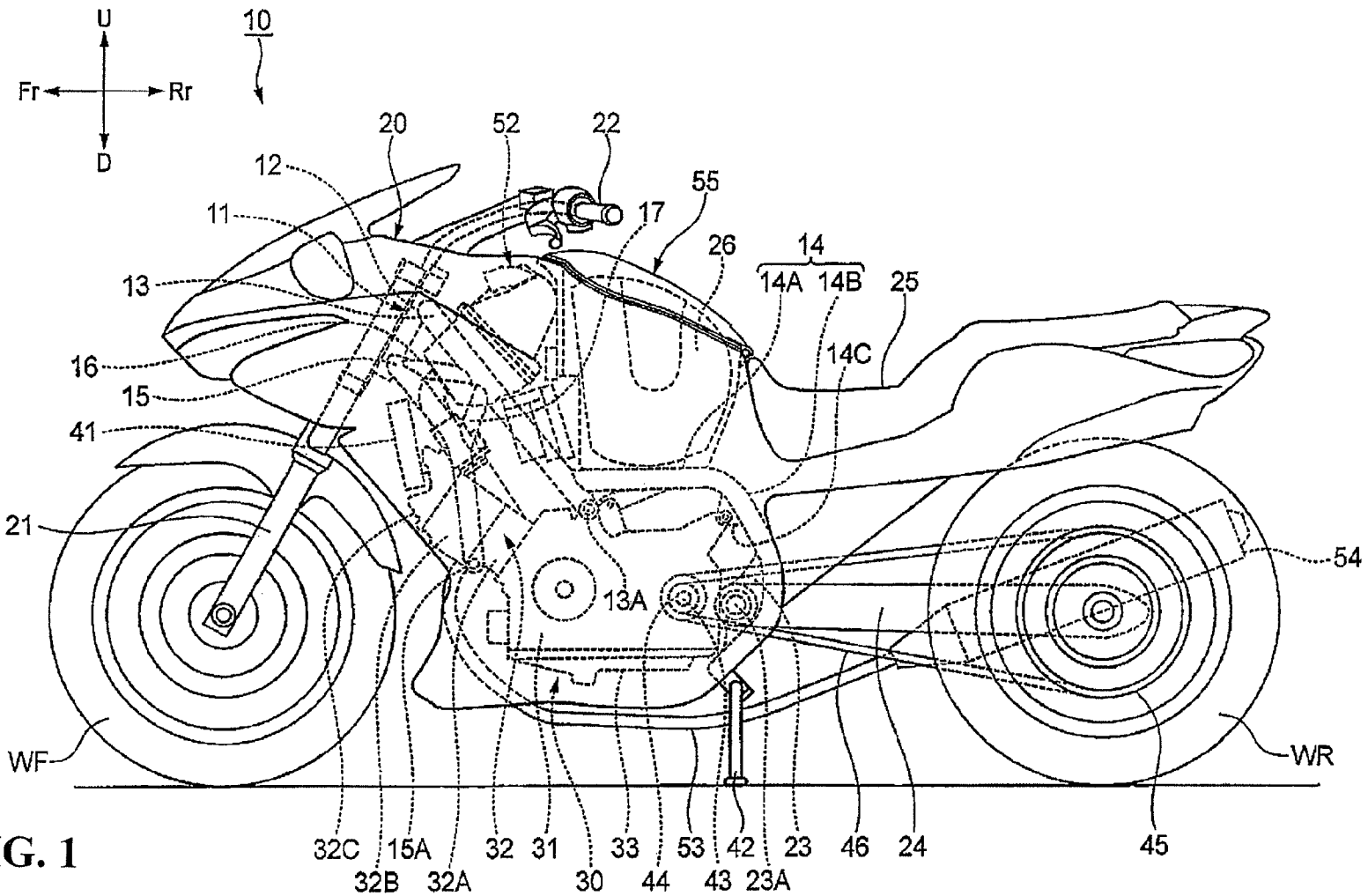
FIG. 1 is a left side view illustrating an embodiment of the motorcycle according to the present invention.

An embodiment of the motorcycle according to the present invention will be described in detail below, referring to the drawings. The drawings are to be viewed according to the positioning of the reference symbols. In the following description, the front and rear, left and right, and upper and lower sides are in accordance with the sides (directions) as viewed from the driver. In the drawings, the front side of the vehicle is indicated as Fr, the rear side as Rr, the left side as L, the right side as R, the upward side as U, and the downward side as D.

As shown in FIG. 1, a motorcycle 10 according to this embodiment has a body frame 11, which is covered with a body cover 20 made of synthetic resin.

The body frame 11 includes: a head pipe 12 provided at the front end; a pair of left and right main frames 13 extending rearwardly downward from the left and right of an upper portion of the head pipe 12; a pair of left and right center frames 14 extending horizontally rearward from the rear ends of the main frames 13 and then extending downward while being bent to project to the rear side; and a pair of left and right down frames 15 extending rearwardly downwardly from the left and right of a lower portion of the head pipe 12. In addition, though not shown in the drawing, the body frame 11 further includes a pair of left and right seat stays and a pair of left and right middle frames which extend rearwardly respectively from rear upper portions and rear end portions of the center frames 14 and which have their rear portions connected together.

A pair of left and right front fork members 21 are supported on the head pipe 12 for steering to the left and right. The front fork members 21 extend downwardly, and rotatably support a front wheel WF on the lower ends thereof. A steering handle 22 is connected to upper portions of the front fork members 21. The center frames 14 are provided with pivot plates 23, and the front end of a rear fork 24 is turnably supported on the pivot plates 23 through a pivot bolt 23A. A rear wheel WR is rotatably supported on the rear ends of the rear fork 24, and the rear fork 24 is supported through a rear cushion (not shown) so that it can be swung up and down.

A rider seat 25 having a driver seat and a pillion passenger seat united together is provided on the upper side of the pair of left and right seat stays. In addition, though omitted in the drawing, a fuel tank is provided between rear portions of the body frame 11 (between the seat stays and the middle frames).

In addition, between the main frame 13 and the down frame 15 disposed to be vertically spaced from each other, first and second reinforcement frames 16 and 17 are provided for interconnecting the main frame 13 and the down frame 15. The first reinforcement frame 16 extends rearward from a front end portion of the down frame 15, to couple the down frame 15 and the main frame 13 to each other. The second reinforcement frame 17 extends downward from the main frame 13 in the vicinity of the rear end of the first reinforcement frame 16, to couple the main frame 13 and the down frame 15 to each other.

An engine (referred to also as a power unit) 30 is supported at a position which is on the lower side of the main frames 13 and horizontal sections 14A of the center frames 14 and which is on the front side of downwardly extending sections 14B of the center frames 14. The engine 30 is a water-cooled parallel two-cylinder engine, and has a cylinder section 32 which is disposed, in a forwardly tilted state, at a front upper portion of a crankcase 31. In addition, with regard to the engine 30, a front upper portion of the crankcase 31 is supported by rear end portions 13A of the pair of left and right main frames 13, a rear upper portion of the crankcase 31 is supported by a pair of left and right engine hangers 14C provided between the horizontal sections 14A and the downwardly extending sections 14B of the center frames 14, and the cylinder section 32 is supported by rear end portions 15A of the pair of left and right down frames 15.

Further, the cylinder section 32 includes a cylinder block 32A formed to be integral with the front upper portion of the crankcase 31, a cylinder head 32B connected to an upper portion of the cylinder block 32A, and a cylinder head cover 32C covering an upper portion of the cylinder head 32B. An oil pan 33 is connected to a lower end portion of the crankcase 31. In addition, a side stand 42 is attached to a lower end portion of the center frame 14 on the vehicle left side.

A rotational driving force outputted from the engine 30 is transmitted to the rear wheel WR through an output shaft 43 projecting from a left side surface of a rear portion of the crankcase 31, a drive sprocket 44 attached to the output shaft 43, a driven sprocket 45 attached to the left side of the rear wheel WR, and a drive chain 46 wrapped around the drive sprocket 44 and the driven sprocket 45.

Figure 2:
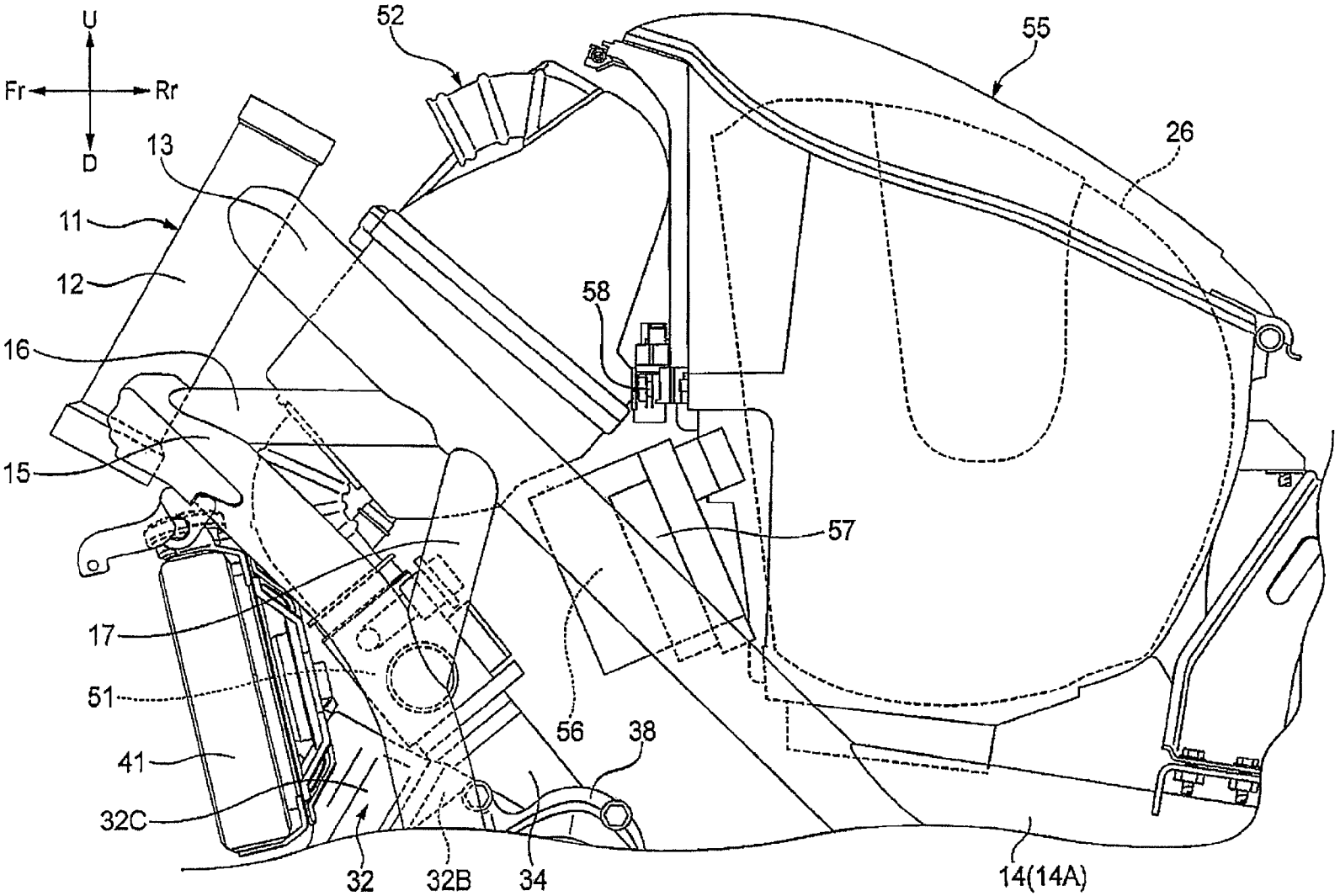
FIG. 2 is an enlarged left side view of the surroundings of an air cleaner and a storage box shown in FIG. 1.
Figure 3:
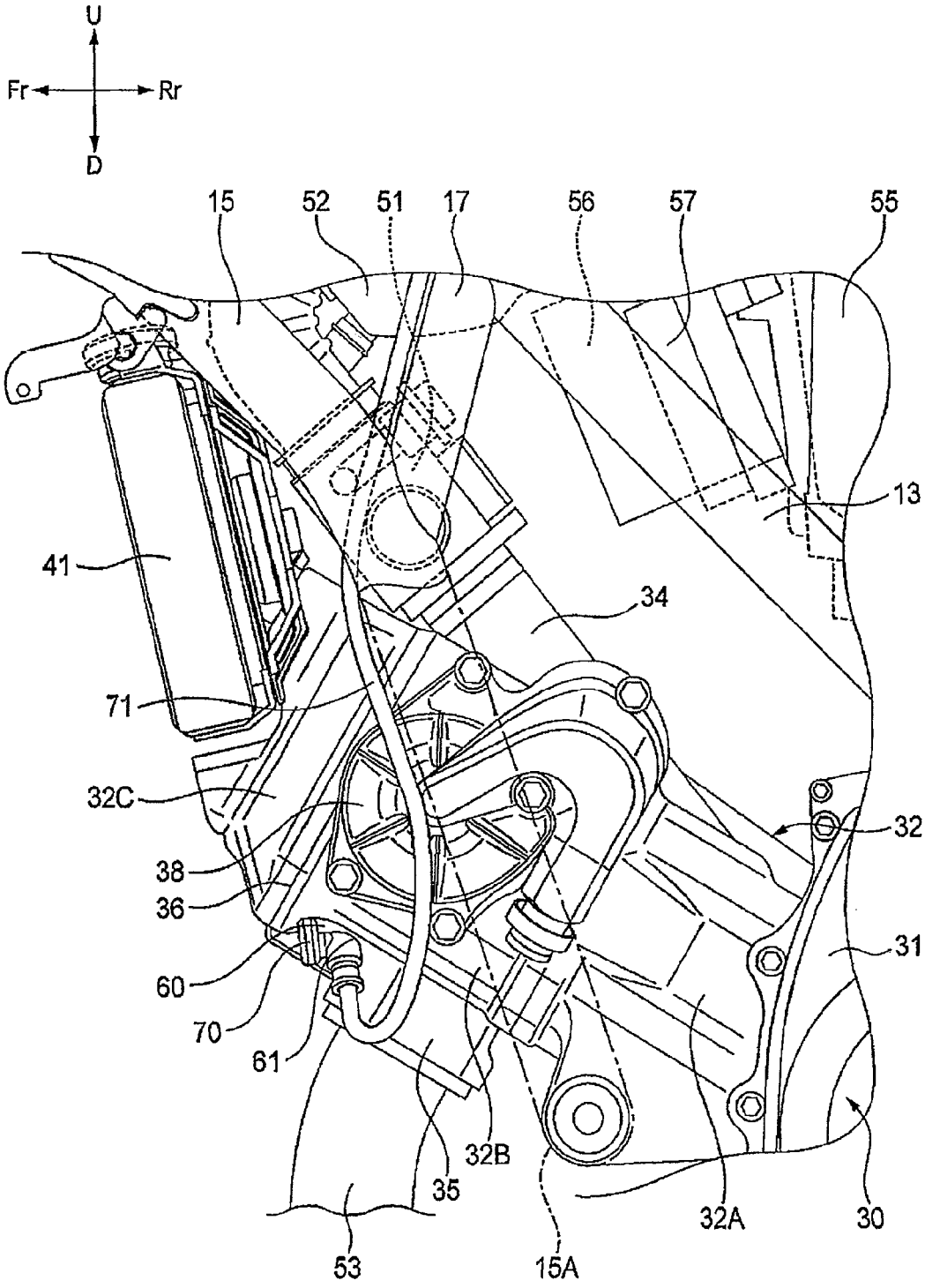
FIG. 3 is an enlarged left side view of the surroundings of a cylinder section shown in FIG. 1.

As illustrated in FIG. 2, a throttle body 51 and an air cleaner device 52 constituting an engine intake system are sequentially connected to an intake manifold section 34 formed at a back surface of the cylinder head 32B. In addition, as shown in FIGS. 1 and 3, an exhaust pipe 53 and a muffler 54 constituting an engine exhaust system are sequentially connected to an exhaust manifold section 35 formed at a front surface of the cylinder head 32B.

As illustrated in FIG. 2, a storage box 55 having a capacity sufficient to store a full-face type helmet 26 is disposed on the rear side of the air cleaner device 52 and on the upper side of the pair of left and right center frames 14. In addition, a battery 56, a fuse box 57, and an inclination sensor 58 are provided between the air cleaner device 52 and the storage box 55.

Further, as shown in FIGS. 4 through 7, tubular sections 60, 60 for containing spark plugs (not shown) therein are formed at a front surface of the cylinder head 32B in the state of being oriented roughly forward.

Figure 4:
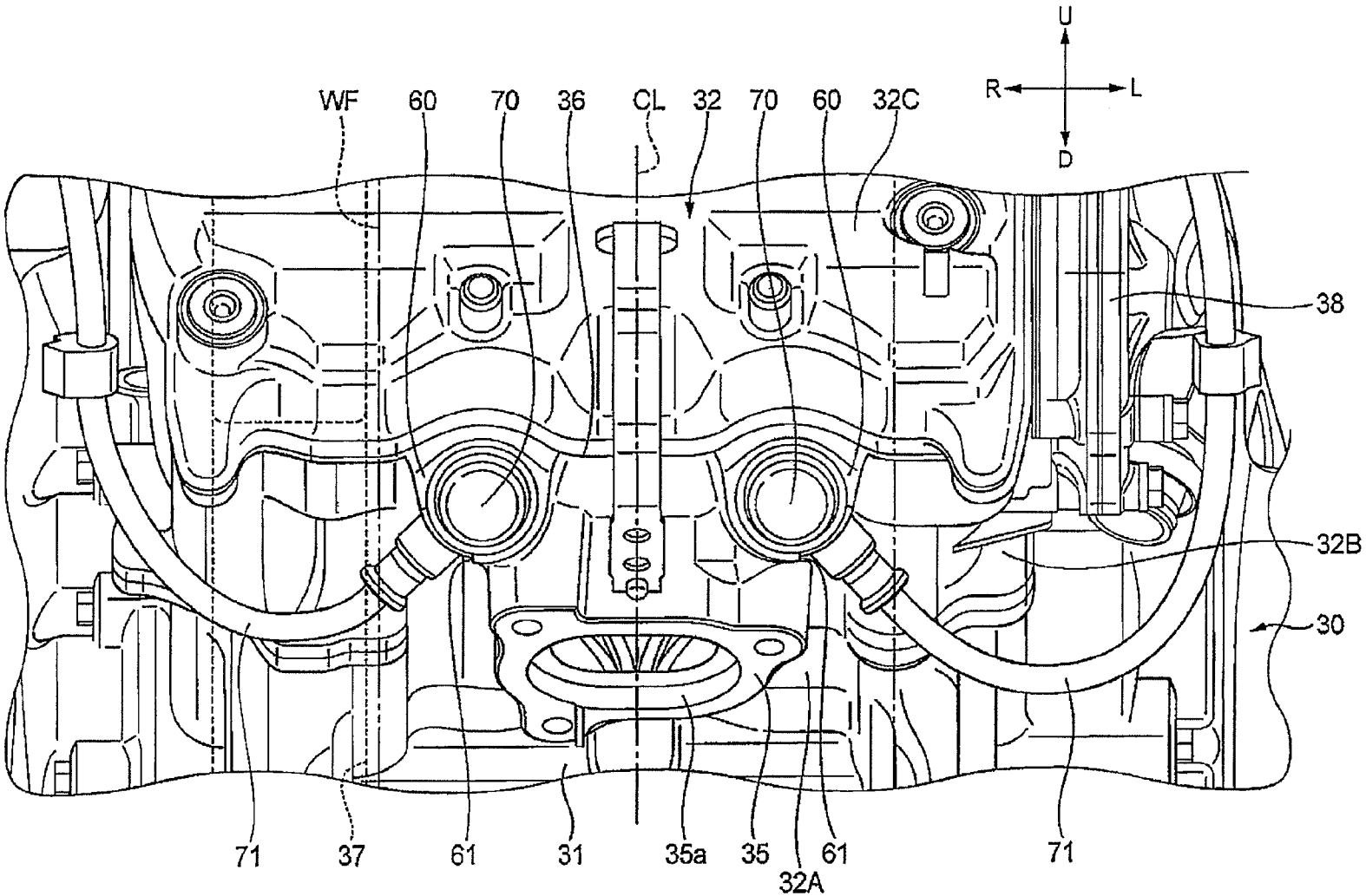
FIG. 4 is an enlarged front view of the surroundings of the cylinder section shown in FIG. 3.
Figure 5:
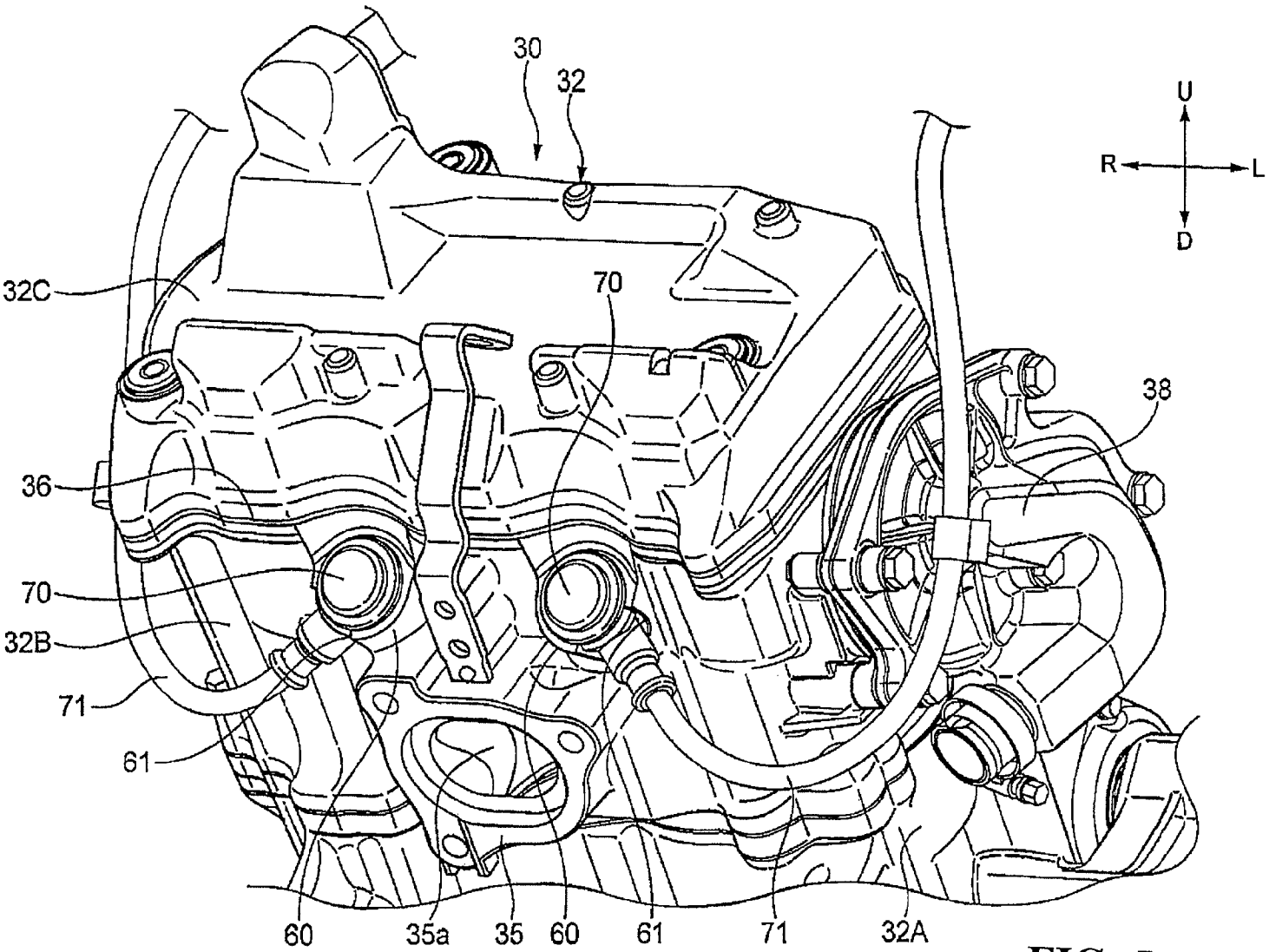
FIG. 5 is an enlarged perspective view of the surroundings of the cylinder section shown in FIG. 3.

In addition, as shown in FIGS. 4 and 5, spark plug caps 70 each of which is connected to the spark plug (not shown) in the inside of the tubular section 60 with a high-tension cord 71 connected to an upper side surface thereof are fitted to the tubular sections 60, 60, respectively.

As illustrated in FIGS. 4 through 7, those portions of the tubular sections 60, 60 which project from the cylinder head 32B are formed respectively with roughly U-shaped cutouts 61 in each of which the high-tension cord 71 is contained in the state of being directed to a lateral side of the tubular section 60. In addition, as shown in FIG. 4, the cutouts 61 are formed to be oriented outward with reference to a center line CL of the engine 30 passing through the center of vehicle width when the engine 30 is mounted on the vehicle. The front wheel WF is disposed on an imaginary extension line, in the vehicle front-rear direction, of the center line CL of the engine 30.

As shown in FIG. 3, the spark plug caps 70 are disposed on the rear side relative to the lower end of a fastening surface 36 between the cylinder head cover 32C and the cylinder head 32B.

In addition, as shown in FIG. 4, the pair of left and right high-tension cords 71 are disposed to oppositely extend in the directions from the center line CL of the engine 30 toward the outer sides, in front view of the vehicle. As shown in FIG. 3, the high-tension cords 71 are disposed on the rear side of the front end of the cylinder head cover 32C of the engine 30. Further, each of the high-tension cords 71 is so disposed that a part thereof extends along the down frame 15 of the body frame 11.

Figure 7:
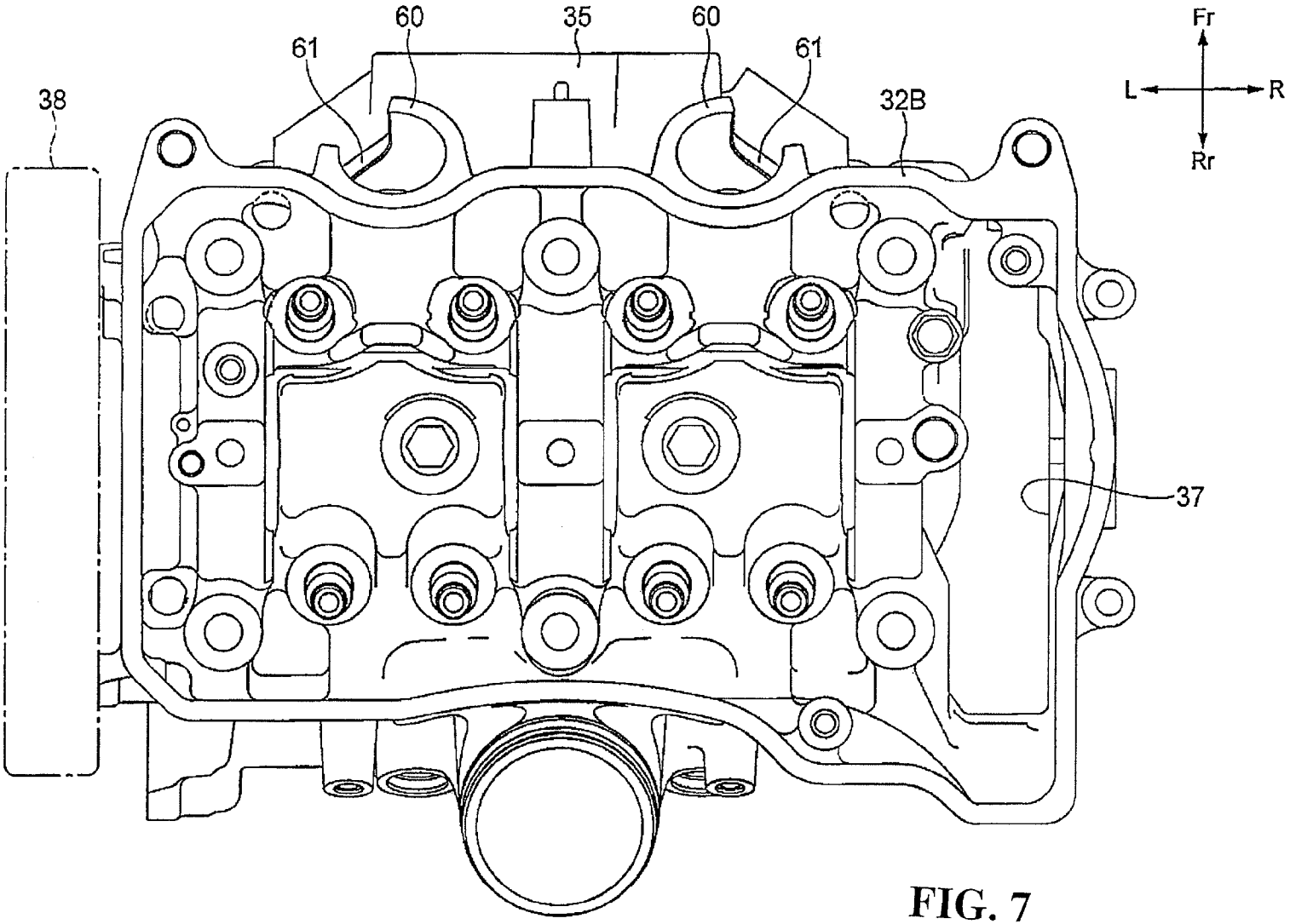
FIG. 7 is a plan view of the cylinder head as a single part.

In addition, as shown in FIGS. 4 and 7, the cylinder head 32B of the engine 30 is formed with a cam chain chamber 37 on the right side in the vehicle width direction, whereas a water pump 38 is attached to a left side surface in the vehicle width direction of the cylinder head 32B, and the cutouts 61 are formed below the cam chain chamber 37 and the water pump 38.

Figure 6:
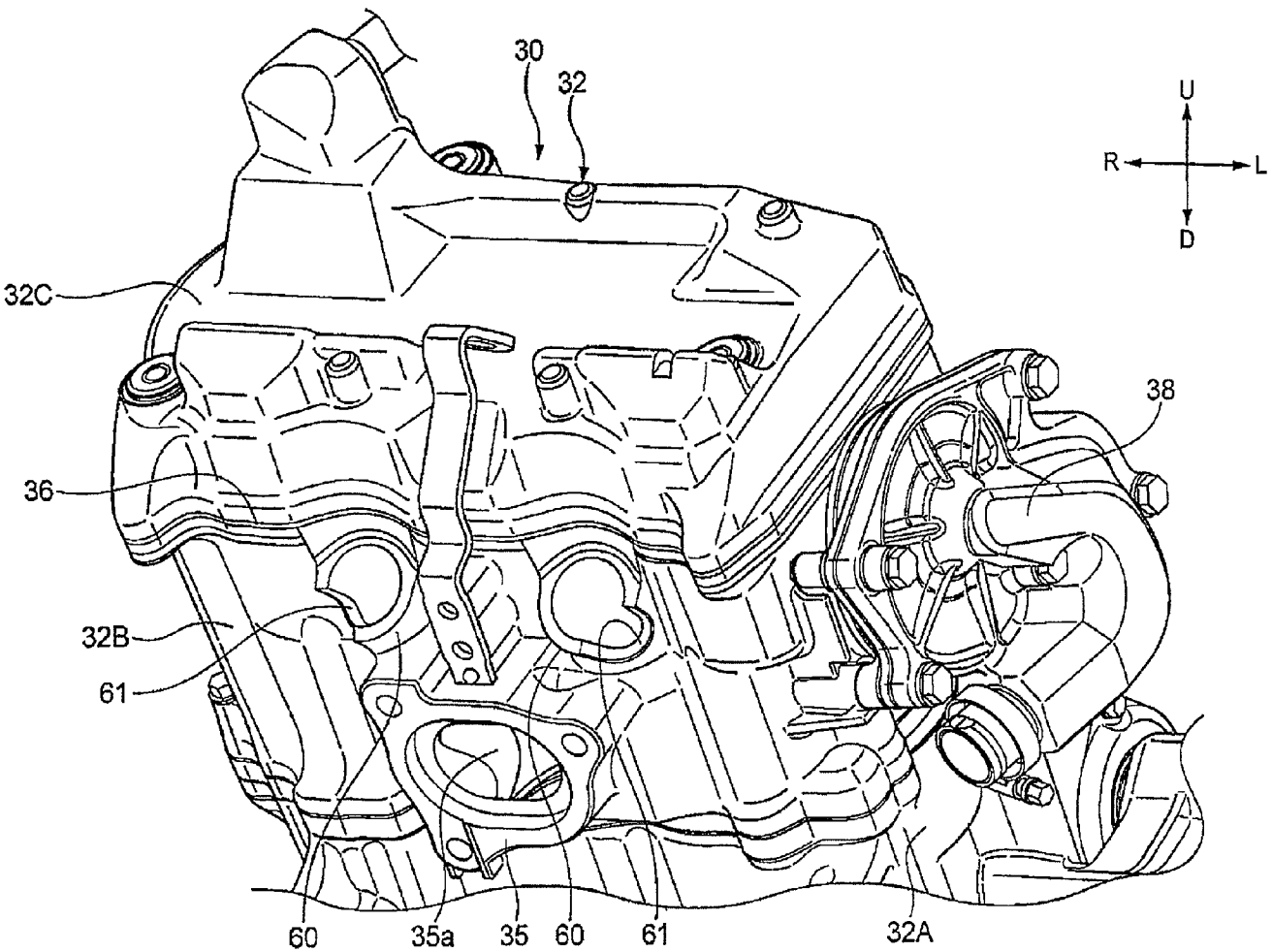
FIG. 6 is an enlarged perspective view of a condition where a spark plug cap has been detached from a cylinder head shown in FIG. 5.

As illustrated in FIGS. 4 through 6, the exhaust manifold section 35 having an exhaust port 35*a* for connection with the exhaust pipe 53 is formed at that portion of the front surface of the cylinder head 32 which is located between the pair of left and right spark plug caps 70. The high-tension cords 71 are connected to the spark plug caps 70 in such a manner so as to extend in the directions from the exhaust port 35*a* toward the outer sides, respectively.

As has been described above, according to the motorcycle 10 in this embodiment, most parts of the spark plug caps 70 are contained in the cylinder head 32B, and the upper side of the spark plug caps 70 is surrounded by the tubular sections 60, so that the spark plug caps 70 can be protected. In addition, the high-tension cords 71 are contained in the cutouts 61 of the tubular sections 60 in the state of being directed to the lateral sides of the tubular sections 60. Therefore, the high-tension cords 71 do not project toward the front side, so that the spacing between the high-tension cords 71 and the front wheel WF can be kept wider, as compared with the case where the cutouts 61 are not provided. This ensures that, even though the spark plug caps 70 are disposed on the front side of the cylinder head 32B, approaching between the front wheel WF and the spark plug caps 70 as well as the high-tension cords 71 can be prevented, without increasing the front-rear length of the vehicle 10.

According to the motorcycle 10 in this embodiment, the tubular sections 60 are formed in a plurality according to the number of cylinders. Therefore, even in a multi-cylinder engine, approaching between the front wheel WF and the spark plug caps 70 as well as the high-tension cords 71 can be prevented, without increasing the front-rear length of the vehicle 10.

According to the motorcycle 10 in this embodiment, the cutouts 61 are formed to be oriented outwardly with reference to the center line CL of the engine 30, and the front wheel WF is disposed on the imaginary extension line, in the vehicle front-rear direction, of the center line CL. Therefore, intrusion of water or mud splashed from the front wheel WF can be prevented by the tubular sections 60 more assuredly, while passing the high-tension cords 71 through the tubular sections 60 in a compacter manner, as compared with the case where the cutouts 61 are formed to be oriented inward with reference to the center line CL.

According to the motorcycle 10 in this embodiment, the pair of left and right high-tension cords 71 are disposed to oppositely extend toward the outer sides with reference to the center line CL of the engine 30, in front view of the vehicle. Therefore, the pair of left and right high-tension cords 71 can be prevented from being entangled with each other, whereby mountability of the high-tension cords 71 can be enhanced.

According to the motorcycle 10 in this embodiment, the high-tension cords 71 are disposed on the rear side relative to the front end of the cylinder head cover 32C of the engine 30, in side view of the vehicle. Therefore, the high-tension cords 71 can be prevented from projecting toward the front side of the engine 30, whereby approaching between the high-tension cords 71 and the front wheel WF can be prevented.

In addition, according to the motorcycle 10 in this embodiment, the spark plug caps 70 are disposed on the rear side relative to the lower end of the fastening surface 36 between the cylinder head cover 32C and the cylinder head 32B. Therefore, the spark plug caps 70 can be prevented from projecting forward, and approaching between the spark plug caps 70 and the front wheel WF can be prevented.

According to the motorcycle 10 in this embodiment, the cam chain chamber 37 is provided on the right side, in the vehicle width direction, of the cylinder head 32B of the engine 30, whereas the water pump 38 is provided on the left side, and, while keeping this condition, the cutouts 61 are formed below the cam chain chamber 37 and the water pump 38. Accordingly, component parts can be laid out intensively at or around the cylinder head 32B, and the engine 30 can be made compact.

In addition, according to the motorcycle 10 in this embodiment, a part of each of the high-tension cords 71 is laid out along the down frame 15 of the body frame 11. Therefore, the high-tension cords 71 can be mounted in a compact form, without providing any superfluous space.

According to the motorcycle 10 in this embodiment, the high-tension cords 71 are attached to the spark plug caps 70 in such a manner so as to extend toward the outer sides with reference to the exhaust port 35*a*. Therefore, while providing the spark plug caps 70 in the vicinity of the exhaust port 35*a*, it is possible to avoid approaching between the high-tension cords 71 and the exhaust pipe 53 serving as a component part of the exhaust system, and to lay out the component parts intensively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A motorcycle comprising:

an engine having a cylinder head disposed in a forwardly tilted state;

a tubular section for containing a spark plug therein, said tubular section projecting roughly forward from a front surface of the cylinder head;

a spark plug cap operatively connected to the spark plug in the inside of the tubular section, said spark plug cap includes a high-tension cord connected to a side portion thereof and being fitted to the tubular section; and a portion of the tubular section which projects from the cylinder head is formed with a cutout for containing the high-tension cord in the state of being directed toward a lateral side of the tubular section, wherein the engine includes:

a cam chain chamber located on one side in a vehicle width direction when the engine is mounted on the vehicle, and a water pump on an opposite side; and the cutout is formed below the cam chain chamber and the water pump.

2. The motorcycle according to claim 1, wherein the engine is a multi-cylinder engine having a plurality of cylinders, and a plurality of tubular sections are formed corresponding to the number of the cylinders.

3. The motorcycle according to claim 2, wherein the cutout is formed to be oriented outwardly with reference to a center line of the engine passing through the center of a vehicle width when the engine is mounted on the vehicle; and a front wheel is disposed on an imaginary extension line, in the vehicle front-rear direction, of the center line.

4. The motorcycle according to claim 2, wherein a plurality of high-tension cords is provided, said plurality of high-tension cords being disposed to oppositely extend toward outer sides with reference to the engine, in a front view.

5. The motorcycle according to claim 2, wherein the high-tension cord is disposed on the rear side relative to a front end of the engine, in a side view.

6. The motorcycle according to claim 1, wherein the cutout is formed to be oriented outwardly with reference to a center line of the engine passing through the center of a vehicle width when the engine is mounted on the vehicle; and a front wheel is disposed on an imaginary extension line, in the vehicle front-rear direction, of the center line.

7. The motorcycle according to claim 6, wherein a plurality of high-tension cords is provided, said plurality of high-tension cords being disposed to oppositely extend toward outer sides with reference to the engine, in a front view.

8. The motorcycle according to claim 6, wherein the high-tension cord is disposed on the rear side relative to a front end of the engine, in a side view.

9. The motorcycle according to claim 1, wherein a plurality of high-tension cords is provided, said plurality of high-tension cords being disposed to oppositely extend toward outer sides with reference to the engine, in a front view.

10. The motorcycle according to claim 9, wherein the high-tension cord is disposed on the rear side relative to a front end of the engine, in a side view.

11. The motorcycle according to claim 1, wherein the high-tension cord is disposed on the rear side relative to a front end of the engine, in a side view.

12. The motorcycle according to claim 1, wherein the engine has a cylinder head cover, and the spark plug cap is disposed on the rear side relative to a lower end of a fastening surface between the cylinder head cover and the cylinder head.

13. An engine adapted to be used with a motorcycle comprising:

a cylinder head disposed in a forwardly tilted state;

left and right tubular sections, each containing a spark plug therein, said tubular sections projecting roughly forward from a front surface of the cylinder head;

a spark plug cap operatively connected to the spark plug disposed within each of the tubular sections, each of said spark plug caps includes a high-tension cord connected to a side portion thereof and being fitted to the respective tubular section; and a portion of each of the left and right tubular sections which projects from the cylinder head is formed with a cutout for containing the high-tension cord, the high-tension cord of the left tubular section being directed toward a left lateral side of the left tubular section, and the high-tension cord of the right tubular section being directed toward a right lateral side of the left tubular section.

14. The motorcycle according to claim 1, wherein a part of the high-tension cord is disposed along a down frame of a body frame.

15. The motorcycle according to claim 13, wherein the engine includes a cam chain chamber located on one side in a vehicle width direction when the engine is mounted on the vehicle, and a water pump on the other side; and each of the cutouts is formed below the cam chain chamber and the water pump.

16. The engine adapted to be used with a motorcycle according to claim 13, wherein each of the cutouts is formed to be oriented outwardly with reference to a center line of the engine passing through the center of a vehicle width when the engine is mounted on the vehicle; and a front wheel is disposed on an imaginary extension line, in the vehicle front-rear direction, of the center line.

17. The engine adapted to be used with a motorcycle according to claim 13, wherein an exhaust port is formed between the spark plug caps, and the high-tension cords are attached to the spark plug caps and extend outwardly with reference to the exhaust port.

18. The motorcycle according to claim 13, wherein the engine has a cylinder head cover, and each of the spark plug caps is disposed on the rear side relative to a lower end of a fastening surface between the cylinder head cover and the cylinder head.

19. A motorcycle comprising:

an engine having a cylinder head disposed in a forwardly tilted state;

a tubular section for containing a spark plug therein, said tubular section projecting from a front surface of the cylinder head in a direction that is substantially forward;

a spark plug cap operatively connected to the spark plug in the inside of the tubular section, said spark plug cap includes a high-tension cord connected to a side portion thereof and being fitted to the tubular section; and a portion of the tubular section which projects from the cylinder head is formed with a cutout for containing the high-tension cord in the state of being directed toward a lateral side of the tubular section; and the cutout is formed below the cam chain chamber and the water pump.

20. The motorcycle according to claim 19, wherein the engine has a cylinder head cover, and the spark plug cap is disposed on the rear side relative to a lower end of a fastening surface between the cylinder head cover and the cylinder head.

* * * * *